US006065591A

United States Patent [19]

Dill et al.

[11] Patent Number: 6,065,591

[45] **Date of Patent: *May 23, 2000**

[54] NON-RESEALABLE WET WIPE PACKAGE

[75] Inventors: Kevin Dill, Walpole; Deborah L. Elsea, Norwood, both of Mass.

[73] Assignee: BBA Nonwovens Simpsonville, Inc., Simpsonville, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/994,513

[22] Filed: Dec. 19, 1997

[51] Int. Cl.[7] ..... B65D 69/00

[52] U.S. Cl. ..... 206/233; 206/494

[58] Field of Search ..... 206/494, 233; 383/60

[56] References Cited

U.S. PATENT DOCUMENTS

| | | | |
|---|---|---|---|
| Re. 31,885 | 5/1985 | Meitner . | |
| 2,199,712 | 5/1940 | Neilson . | |
| 2,574,345 | 11/1951 | Montgemery | 206/494 |
| 2,730,267 | 1/1956 | Marcalus | 221/48 |
| 3,193,137 | 7/1965 | McCarthy et al. | 206/278 |
| 3,684,086 | 8/1972 | Harrison | 206/494 |
| 3,784,056 | 1/1974 | Spruyt et al. | 206/494 |
| 4,041,203 | 8/1977 | Brock et al. . | |
| 4,298,649 | 11/1981 | Meitner . | |
| 4,436,780 | 3/1984 | Hotchkiss et al. . | |
| 4,458,810 | 7/1984 | Mahoney | 206/494 |
| 4,487,318 | 12/1984 | Roen | 206/494 |
| 4,522,863 | 6/1985 | Keck et al. . | |
| 4,533,399 | 8/1985 | Mencke . | |

FOREIGN PATENT DOCUMENTS

| | | |
|---|---|---|
| 488967 | 6/1992 | European Pat. Off. . |
| 406048475 | 2/1994 | Japan . |

OTHER PUBLICATIONS

Hayssen/Bossar Stand–up/Gusseted/Flat Pouch Packaging Systems, Hayssen, A Barry–Wehmiller Co. Duncan, South Carolina.

Various sales brochures for Eagle safety plunger, safety bench and safety daub cans—Wellsburg, West Virginia.

Pp. 34–35 of "Protoseal Company". Chicago, Illinois (1928).

Dec. 1997 Print–out from Protectoseal Website (1996)—plunger and bench cans.

Website and catalog page describing "Dawg" plunger cans.

(List continued on next page.)

*Primary Examiner*—M. D. Patterson
*Assistant Examiner*—Trinh T. Nguyen
*Attorney, Agent, or Firm*—Ostrager Chong; Flaherty & Onofrio, P.C.

[57] ABSTRACT

A non-resealable package for wet wipes has a base layer and a flexible top layer which overlays a stack of wet wipes and is sealed to the base layer, and a slit is formed in the flexible top layer along one side of the stacked lateral edges of the stack near a topmost-lying one of the wipes. The top layer is made of a selected flexible material and the slit is positioned and cut with a selected length such that opposing slit ends of the flexible top layer can be pushed apart by a user with fingers of one hand while keeping evaporation of solvent or fluid to a low level. In one version, the slit is simply cut through the top layer and closed with a membrane and adhesive-coated covering for shipping and storage. In another version, a reinforcing layer of greater thickness or stiffness is adhered to the top layer around the slit so that the slit edges tend to resume their initial positions and realign to minimize the open area of the slit when the user's fingers are withdrawn. The stack-edge positioned slit allows wet wipes to be withdrawn with one hand without the need to reseal the slit opening. It is especially suitable for packaging of wet wipes impregnated with solvent for use in an industrial environment.

14 Claims, 5 Drawing Sheets

U.S. PATENT DOCUMENTS

| | | | |
|---|---|---|---|
| 4,622,258 | 11/1986 | Mencke . | |
| 4,659,609 | 4/1987 | Lamers et al. . | |
| 4,678,698 | 7/1987 | Mencke . | |
| 4,679,693 | 7/1987 | Forman . | |
| 4,775,582 | 10/1988 | Abba et al. . | |
| 4,778,048 | 10/1988 | Kaspar et al. . | |
| 4,784,892 | 11/1988 | Storey et al. . | |
| 4,833,003 | 5/1989 | Win et al. . | |
| 4,853,281 | 8/1989 | Win et al. . | |
| 4,863,064 | 9/1989 | Dailey, III | 206/494 |
| 4,879,442 | 11/1989 | Giovine | 206/494 |
| 4,904,521 | 2/1990 | Johnson et al. . | |
| 4,906,513 | 3/1990 | Kebbel et al. . | |
| 5,039,431 | 8/1991 | Johnson et al. . | |
| 5,145,727 | 9/1992 | Potts et al. . | |
| 5,149,576 | 9/1992 | Potts et al. . | |
| 5,178,931 | 1/1993 | Perkins et al. . | |
| 5,178,932 | 1/1993 | Perkins et al. . | |
| 5,219,421 | 6/1993 | Tipping | 206/494 |
| 5,223,329 | 6/1993 | Amann . | |
| 5,229,191 | 7/1993 | Austin . | |
| 5,259,984 | 11/1993 | Hull . | |
| 5,316,177 | 5/1994 | Boldt | 206/494 |
| 5,429,854 | 7/1995 | Currie et al. . | |
| 5,589,258 | 12/1996 | Maddern et al. . | |
| 5,595,786 | 1/1997 | McBride, Jr. et al. . | |
| 5,664,677 | 9/1997 | O'Connor | 206/494 |
| 5,704,471 | 1/1998 | Yamada | 206/494 |

NON-RESEALABLE WET WIPE PACKAGE

TECHNICAL FIELD

This invention generally relates to an improved package for wet wipes, and particularly, a non-resealable package for wet wipes.

BACKGROUND OF INVENTION

Wet wipes are commonly used for cleaning in industrial environments where it is desirable to have them dispensed from packaging in a convenient manner. In industrial environments, workers often have their hands busy, so that it is desirable to have wet wipes dispensed from a package in a manner that would allow them to be grasped easily with one hand from the package without requiring or occupying the other hand. In some types of industrial uses, the wet wipes are impregnated with solvents or other volatile chemicals, so that it is also desirable that the dispensing package have the ability to retain evaporant vapors within the package where they will not endanger the health of the workers. For example, solvent-impregnated wet wipes are used on car assembly lines for cleaning the surfaces of car bodies prior to spray painting.

Accomplishing both these objectives in packaging for solvent-impreganted wet wipes has been problematic. Since the solvent-impregnated wet wipe for industrial use can be quite thick and bulky, a large opening is required to remove the wet wipe from the package. However, a large opening can allow too much solvent vapor to escape into the ambient environment where it may present a health or environmental risk. Therefore, the prior art teaches that using a resealable package is necessary to contain evaporation of the solvent.

As illustrated in FIG. 1, a prior art packaging system, such as disclosed in U.S. Pat. No. 5,595,786 to McBride, has a stack of wet wipes 10 contained in a package 12 formed by top and bottom panels 12*a*, 12*b* that are sealed together. The top panel 12*a* has an elongated central opening 14 formed by a through-cut in the panel material that leaves a flap 14*a* that remains attached to the top panel 12*a* by a hinge portion. A wet wipe is retrieved by lifting the hinged flap and pinching and pulling up a wet wipe through the opening. A resealable door member 16 has an adhesive layer 16*a* on its lower surface which is attached to and overlies the boundaries of the flap so that the door member can be re-sealed to cover the top panel opening in between wet wipe retrievals. Another example of a prior art package is shown in FIG. 2 formed with flexible top and bottom sheets and a similar type of hinged flap for resealing a central opening in the package. Other proposals include a tube type of outer package having one end resealed with a wire or tie closure.

However, in the prior art packaging systems, raising the resealable flap or manipulating the wire or tie closure to gain access to the wipes is a cumbersome two-handed operation which is exacerbated if the workers are wearing gloves to protect their hands from the solvent. One hand is required to hold the package down while the other hand grasps and manipulates the flap or closure to uncover the opening. Then one hand is used to hold the flap open or hold onto the closure device while the other hand is used to pinch and draw out the wipe from the container. It is also difficult, particularly with a gloved hand, to selectively pinch only the top wipe, due to the generally low-friction surface of the wipe and the friction-reducing properties of the solvent. The large opening, which is necessary in the prior art designs to gain access to and to draw out the wipe through the central opening, promotes premature evaporation of the solvent from the wipes in the package. Due to the evaporation problem, the opening must be resealed after each wipe is removed.

When the wet wipes are used in industrial environments, such as cleaning car bodies for painting, the sequence of steps to retrieve a wet wipe with both hands from the conventional type of resealable package can be inconvenient for the duress and time constraints of an assembly line operation. The prior art packaging systems require the use of unnecessary time and energy to procure each wipe. It is therefore desirable to provide a package for dispensing wet wipes, particularly those that are impregnated with solvent, which can be operated easily with one hand to retrieve a wipe in the time constraints of an industrial environment without having to reseal the package.

SUMMARY OF INVENTION

In accordance with the present invention, a package for a stack of wet wipes stacked on top of each other with their lateral edges in parallel with each other has a base layer on which the stack of wipes rests and a flexible top layer which overlays the stack and is sealed to the base layer. A slit is formed in the flexible top layer positioned along one side of the stacked lateral edges of the stack of wipes. Placement of the slit near one lateral side of the stack of wipes allows the top wipe to be retrieved by access through the slit with one hand while at the same time keeping evaporation of solvent or fluid to a low level.

Two versions of the slit can be used. In the first version, the slit is positioned near one edge of the stack of wipes and cut with a selected length such that the slit opens to provide access to the edge of the stack of wipes as shown in FIG. 3. In the second version, the top layer of the package around the slit is reinforced so that the edges of the slit can be pushed apart with the fingers of one hand, as shown in FIG. 5*a*, to form an opening into the package to gain access to the top wipe of the stack. The reinforced edges of the slit can realign to resume their initial position substantially closing the opening when the user's fingers are withdrawn. Both versions meet the apparently conflicting requirements of providing easy access to the wipes with one hand, while at the same time preventing excessive solvent evaporation.

Other objects, features, and advantages of the present invention will be explained further in the following detailed description with reference to the appended drawings.

DETAILED DESCRIPTION OF INVENTION

Figure 1:
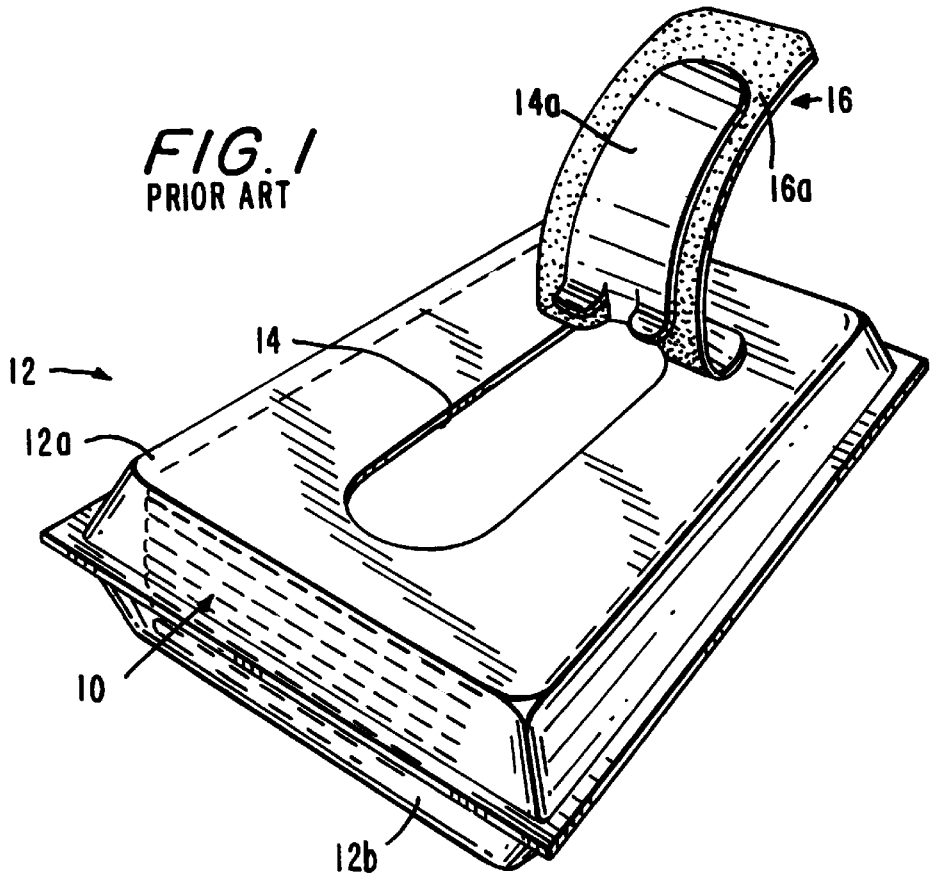
FIG. 1 PRIOR ART
FIGS. 1 and 2 are illustrations of prior art packages of the type employing a central opening with a resealable flap or closure.
Figure 2:
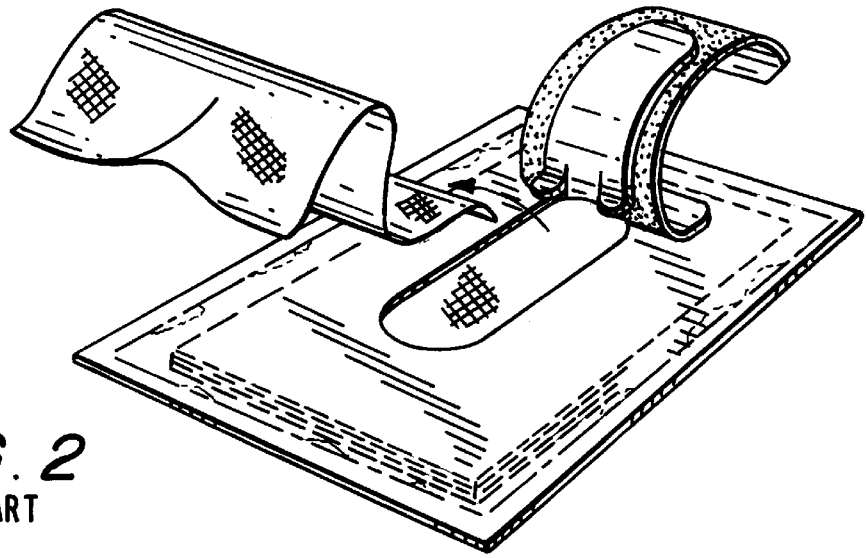
FIG. 2 PRIOR ART
Figure 3:
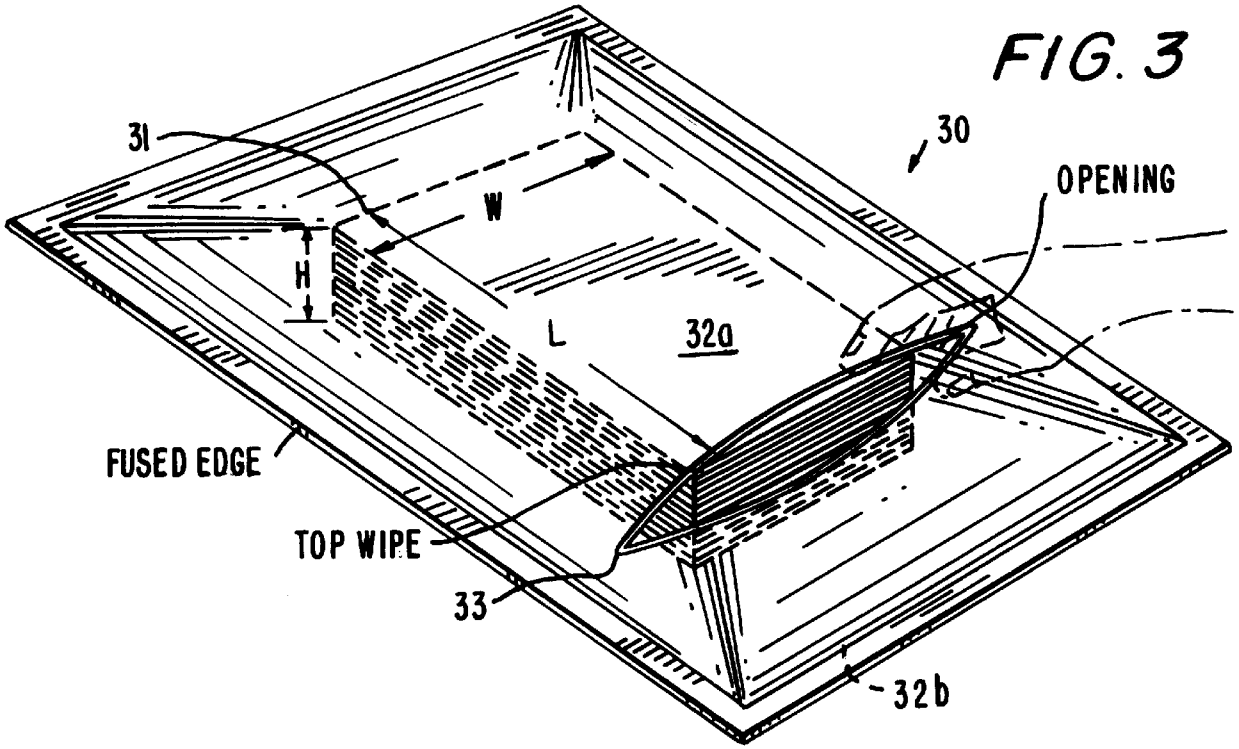
FIG. 3 is a perspective view of a package employing a first version of a stack-edge aligned and positioned slit formed with a selected length through a top layer of the package.

Referring to a first version shown in FIG. 3, a package 30 is provided in the present invention for a stack 31 of wet wipes. The wet wipes are stacked on top of each other and have their lateral edges aligned in parallel with each other. The package 30 is formed of a top layer 32*a* and a base layer 32*b* fused together along fused edges or otherwise joined together on all sides. At least the top layer is made of a flexible material which is impervious to moisture and, preferably, to solvents of the type to be contained within the package. For example, the top layer may be made of a laminate which includes a polyethylene layer. A suitable package for filling with wipes is available from Tesco Enterprises, Inc., of Benton, Ariz., which has a laminate construction about 4.4 mils thick.

Figure 4:
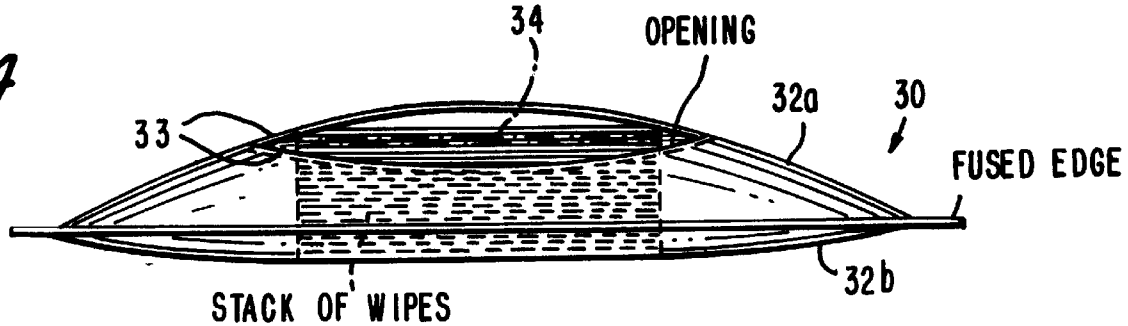
FIG. 4 is an elevational view of the package employing the stack-edge aligned and positioned slit.

As shown in FIG. 4, the stack 31 rests on the base layer 32*b*, and the flexible top layer 32*a* overlies the stack. A slit 34 is formed by cutting a cut of a selected length through the flexible top layer 32*a* aligned in parallel with one side of stacked lateral edges of the stack 31 and positioned proximate the lateral edge of a top wipe of the stack at about the initial height H of the stack prior to use of the wet wipes. In order to gain access to the wipes, the user first removes an outer tape or label (not shown) covering the slit and discards it. The covering is not to be resealed to the package, and the adhesive for attaching it to the package is suitable for shipping and storage only. The adhesive properties of the covering are lost once the outer covering is detached. As indicated in FIG. 4, the user must pierce through a membrane (solid line) closing the slit 34 to form an opening 33 (dashed lines) in the package. The membrane prevents leakage or evaporation of solvent during shipping and storage, and can easily be separated by pulling the slit edges apart. The top wet wipe can then be grasped by its lateral edge from the top of the stack and withdrawn from the package. Once opened, the slit opening remains open to allow access to the edge of the stack of wipes. Evaporation experiments show surprisingly that only very small amounts of solvent evaporate through the open slit when the slit is positioned as described.

In an alternate method for fabricating and filling the package, a full stack of wipes is positioned on a base layer, then a top layer is overlaid on the stack. The top layer has the slit already cut therethrough and held closed with a membrane and covered with an adhesive covering tape. The package is sealed by welding the edges of the base and top layers together on all sides. For use, the covering tape is removed from the slit and the membrane is separated, and the user can withdraw the wipes in succession through the opening in the package.

The critical functions of the slit in the present invention are obtained by carefully selecting the alignment, position, and length of the slit, and also by selecting the properties of the flexible top layer of the package. The slit length should not be too small as to present an impediment to easily withdrawing a wipe through the slit, but not too large as to allow the slit ends to gape open when the user's hand is withdrawn (opened slit 33 shown in FIG. 3). For a stack of wipes that has a height H and a longer length L than its width W, the slit should be aligned with the shorter, width-edges of the stack so that a smaller length of slit can be used to withdraw wipes.

EXAMPLE I

In this example, the stack of wipes consists of 50 quarter-folded wipes each having a weight of 32.2 gsy. The wipes are fabricated of a laminate SMS (spunbond-meltblown-spunbond) construction. The wipes of the stack are impregnated with a solvent of 85% isopropyl alcohol (IPA) and 15% water. The dimensions of the stack were a height H of 1.5 inch, a width W of 7.25 inches, and a length L of 8.5 inches. The dimensions of the package are a outer width of 13.0 inches and inner width of 12.25 inches (unsealed width), and a length of 15.0 inches. The slit is cut to 5.0 inches length centered and in parallel with one widthwise edge of the stack about 4.5 inches from the corresponding lateral widthwise edge of the package.

Figure 6:
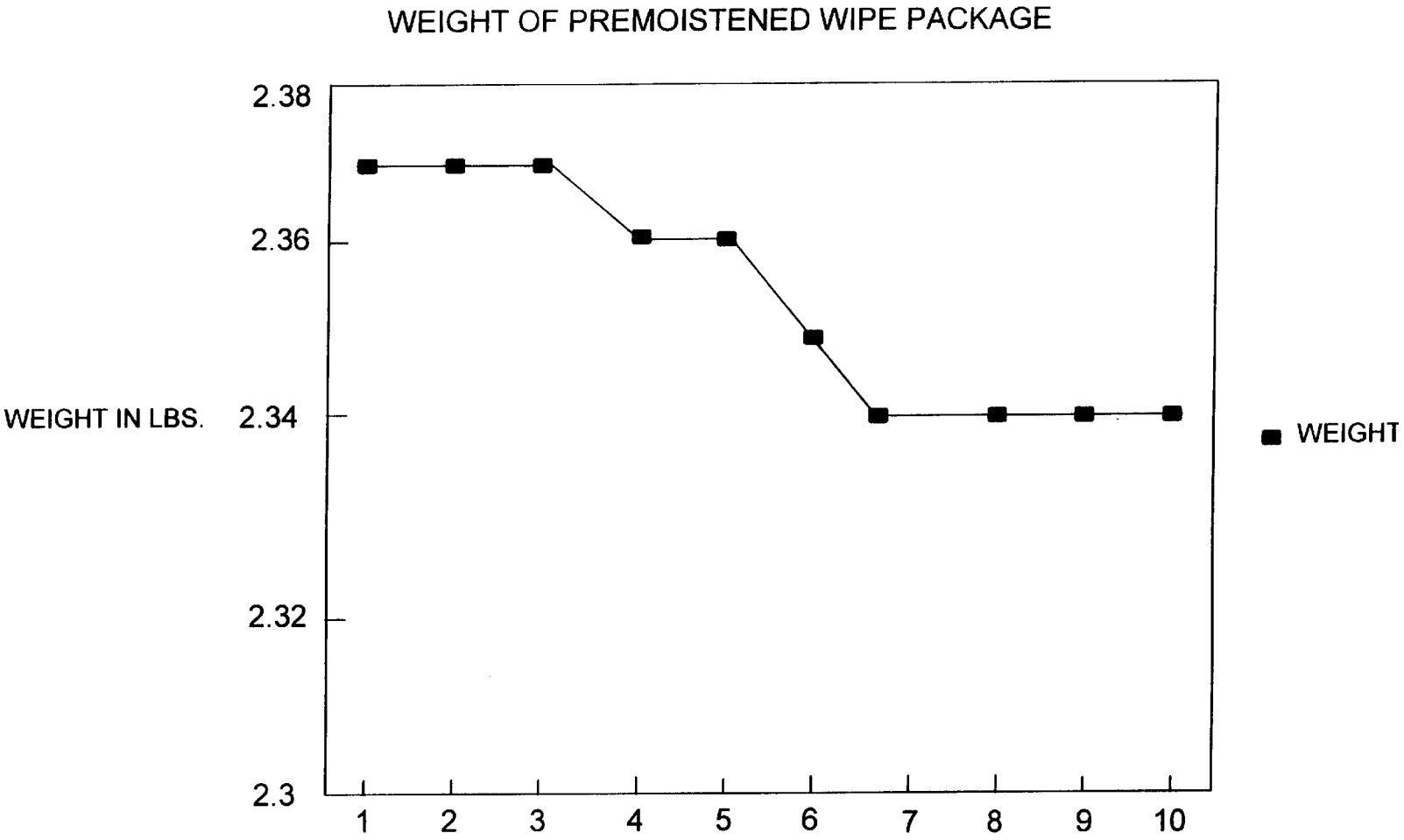
FIG. 6 is a chart illustrating the evaporation rate from wet wipes using the non-resealable package of the invention.

The above example was tested for its effectiveness in minimizing or preventing the escape of solvent vapors. The slit was uncovered and opened as shown in FIG. 3 (as it would be during use) and the contents of the package were measured during the test period to determine the amount of weight of solvent that escaped through the slit in the package. The results of the solvent evaporation measurements over a 36-day period are summarized in the appended Table I. FIG. 6 shows a graph of the rate of evaporation over the initial ten-day period. Surprisingly, the tests showed that the evaporation rate while the wipes are saturated with solvent was only 0.4% in the first three days, and only 1.27% over the first 10 days. The evaporation rate tends to increase as the wipes dry out. The solvent that escapes from the package is only a fraction of a percent as compared to the solvent that escapes from the solvent-saturated wipe when it is used to clean a surface of a car. The test results indicate that the non-resealable package of the invention can thus be used to safely contain solvent evaporation in an industrial environment.

Figure 5A:
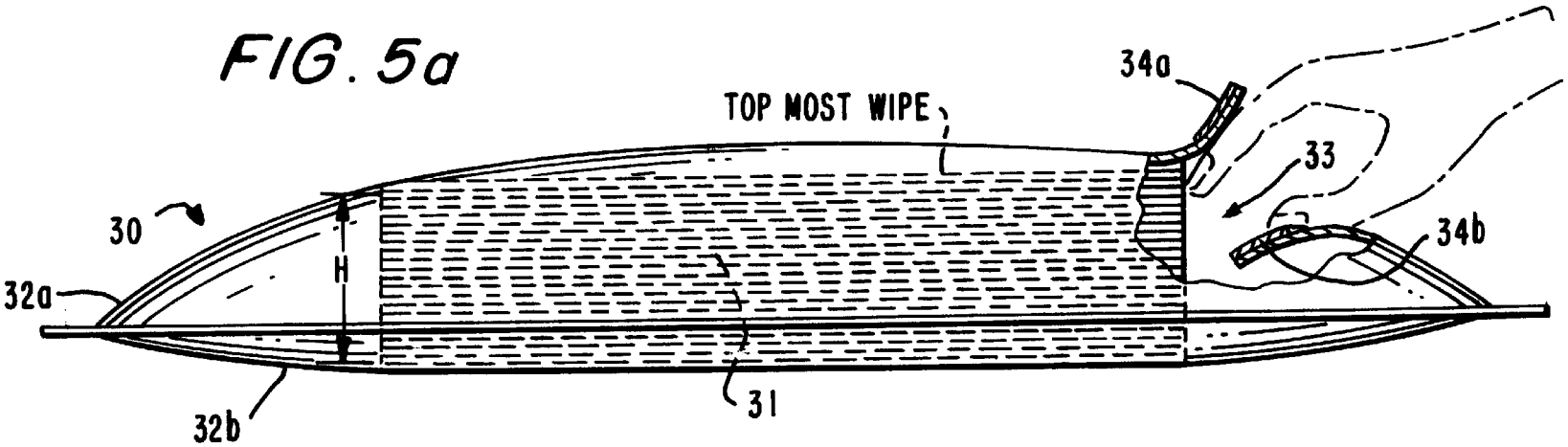
FIGS. 5*a* and 5*b* are side views showing a second version of the slit formed through a reinforced portion of the top layer which can close when a wipe is removed from the stack.

In a second version shown in FIG. 5*a*, the package has a reinforcing layer 34*a*/34*b* adhered to the top layer of the package around the area where the slit is formed. The reinforcing layer can be made of an additional thickness of the laminate material of the package and/or of a sheet material that has a greater stiffness as compared to the top layer. The slit is formed through the top layer 32*a* and the reinforcing layer 34*a*/34*b*. The reinforcing layer and top layer may be perforated or cut and closed with a membrane and/or adhesive covering layer for shipping and storage. Access into the package is obtained by separating the membrane or removing the covering layer from the slit. The length of the slit is made less than the overall length of the reinforcing layer wherein the reinforcing layer retains some stiffness or rigidity so that the separated edges of the slit 34*a* and 34*b* can spring back to their original positions and realign with each other to minimize the open area of the slit when it is not in use.

Figure 5B:
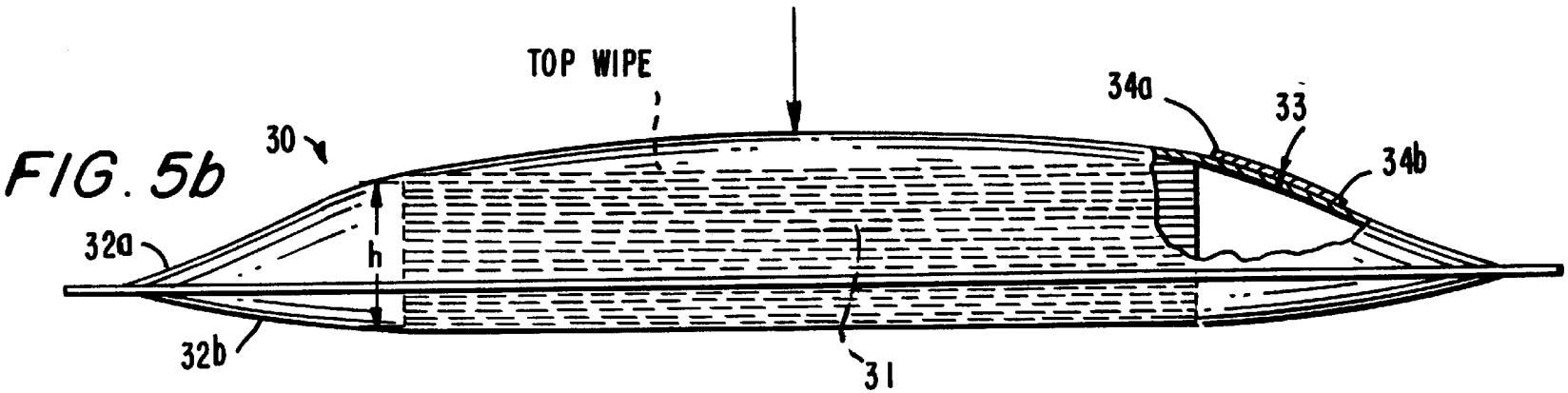

As illustrated in FIG. 5*b*, the reinforcing layer 34 is positioned or spaced by a small distance from the top vertical edge of the stack of wipes, so that the user can push the upper edge 34*a* of the slit up with a forefinger and the lower edge 34*b* down with a thumb to spread them apart to gain access into the package. The flexibility of the top layer material and the greater thickness and/or stiffness of the reinforcing layer allows the edges of the slit 34*a* and 34*b* to realign to their initial positions when the user's hand is withdrawn. Since the open area of the slit is thus minimized, the vapor from the solvent-impregnated wipes remains substantially confined within the package. As the stack is drawn down (with declining height h), the top layer of the package tends to flatten downward under the influence of gravity, and the relative slit position moves incrementally farther out from but still close to the vertical position of the top wipe of the remaining stack. Thus, the top wipe can still be readily grasped and withdrawn even as the stack is drawn down.

Figure 7:
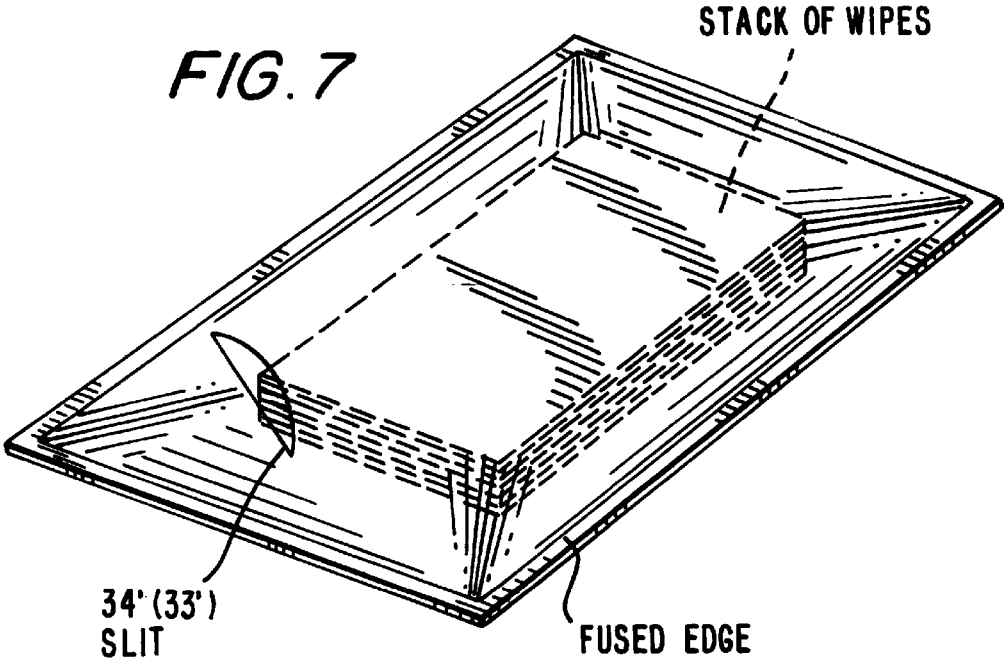
FIG. 7 illustrates another embodiment of a non-resealable package having a slit positioned at a corner of a stack edge.
Figure 8:
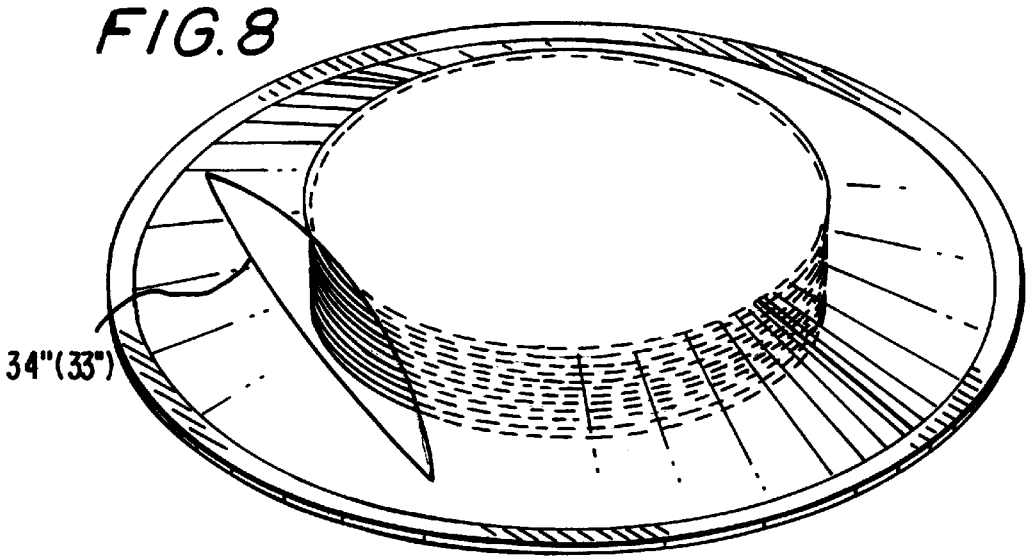
FIG. 8 illustrates a further embodiment of a non-resealable package having a slit positioned at the edge of a circular stack of wipes.

Other examples of the use of a stack-edge positioned slit for a non-resealable package are shown. In FIG. 7, a slit 34' is formed at one corner of the edge of a stack of wipes. The slit length is small in relation to the length and width of the folded wipes on the stack, but its position at the corner allows the top wipe to be withdrawn in a trailing manner through the opening 33'. In FIG. 8, a slit 34" is formed tangent to the annular edge of a circular stack of wipes contained in a circular package and provides an opening 33" for withdrawal of wipes therethrough.

The non-resealable package and stack-edge positioned slit of the present invention can be used in any type of application and with any type of package where wet wipes are expected to be used within a given period of time once the package is unsealed. Even in applications where solvent evaporation is not an issue, for example, water-moistened wipes, the simple structure of the stack-aligned and edge-positioned slit and retarding of drying out of the wipes provides advantages for the user. Eliminating the need to reseal the package makes the package extremely easy and convenient for almost any conceivable use of wet wipes.

It is understood that many modifications and variations may be devised given the above description of the principles of the invention. It is intended that all such modifications and variations be considered as within the spirit and scope of this invention, as it is defined in the following claims.

We claim:

1. A package for a stack of wet wipes saturated with solvent comprising:

the stack of wet wipes having an initial height H formed by a plurality of wet wipes each having a common planar shape extending over a given horizontal area defined by lateral edges and having a given incremental thickness, and being stacked horizontally on top of each other with their lateral edges in parallel to form by their incremental thicknesses the initial height H of the stack prior to use of the stack of wet wipes;

a base layer on which the stack of wipes rests and a flexible top layer which overlays the stack and is sealed to the base layer;

a slit formed in the flexible top layer which is positioned in parallel with and along one side of the lateral edges of the stack of wipes at about the initial height H above the base layer horizontally and in parallel with (or tangent to) a lateral edge along one side of a topmost-lying one of the stack of wipes prior to use of the stack of wet wipes, said slit being openable upon a first use and not having any means for re-sealing the slit closed after it has been opened;

wherein the flexible top layer is made of a selected material and the slit is positioned such that after it has been opened, the opposing, unsealed ends of the flexible top layer formed by the slit can be readily pushed apart by a user with fingers of one hand so as to gain convenient one-handed access into the package to a wipe on the stack, and the positioning of the slit to one side of the stack ensures that the remainder of the package contains evaporation of solvent from the wet wipes from escaping the package.

2. A package according to claim 1, wherein the stack of wet wipes has a length that is longer than its width, and the slit is positioned proximate the stacked lateral edges on a width-wise side of the stack of wipes.

3. A package according to claim 1, wherein the stack of wet wipes has a rectangular shape and the slit is positioned at a corner of the stacked lateral edges of the stack of wipes.

4. A package according to claim 1, wherein the stack of wet wipes has a circular shape and the slit is positioned at a tangent along the stacked lateral edges of the stack of wipes.

5. A package according to claim 1, wherein the slit is cut through the top layer of the package and held closed with a membrane for shipping and storage.

6. A package according to claim 1, wherein the slit is cut through the top layer of the package and held closed with a non-resealable covering layer for shipping and storage.

7. A package according to claim 1, wherein a reinforcing layer is adhered to the top layer of the package around the area where the slit is formed, wherein the reinforcing layer provides some stiffness or rigidity so that the separated edges of the slit can spring back to their original positions and realign with each other to minimize the open area of the slit when it is not in use.

8. A package according to claim 7, wherein the reinforcing layer is made of an additional thickness of the top layer of the package.

9. A package according to claim 7, wherein the reinforcing layer is made of a sheet material that has a greater stiffness as compared to the top layer.

10. A package according to claim 7, wherein the slit is cut with a length that is less than the length of the reinforcing layer so that the reinforcing layer causes the edges of the slit to assume their original positions and realign with each other when the user's hand is withdrawn from the package.

11. A package according to claim 1, wherein the wet wipes are saturated with a solution of isopropyl alcohol solvent and deionized water, and the stack of wipes is of laminate SMS (spunbond-meltblown-spunbond) construction, and wherein the evaporation rate by weight of solvent from the wipes with the slit opened is about 0.4% in the first three days.

12. A package according to claim 1, wherein the wet wipes are saturated with a solution of isopropyl alcohol solvent and deionized water, and the stack of wipes is of laminate SMS (spunbond-meltblown-spunbond) construction, and wherein the evaporation rate by weight of solvent from the wipes with the slit opened is about 1.27% over the first 10 days.

13. A method of using wet wipes saturated with solvent in an industrial environment, comprising the steps of:

forming a stack of solvent-saturated wet wipes stacked on top of each other with their lateral edges in parallel with each other, the stack of wet wipes having an initial height H formed by a plurality of wet wipes each having a common planar shape extending over a given horizontal area defined by lateral edges and having a given incremental thickness, and being stacked horizontally on top of each other with their lateral edges in parallel to form by their incremental thicknesses the initial height H of the stack prior to use of the stack of wet wipes;

sealing the stack of wet wipes in a package made of a base layer on which the stack of wipes rests and a flexible top layer which overlays the stack and is sealed to the base layer;

forming a slit in the flexible top layer of the package which is positioned in parallel with and along one side of the stacked lateral edges of the stack of wipes at about the initial height H above the base layer and horizontally in parallel with (or tangent to) a lateral edge along one side of a topmost-lying one of the stack of wipes prior to use of the stack of wet wipes, said slit being openable upon a first use and not having any means for re-sealing the slit closed after it has been opened;

opening the slit along one side of the stacked lateral edges of the stack of wipes and withdrawing a top one of the wet wipes from the package for use in the industrial environment without resealing the package, wherein the opposing ends of the flexible top layer formed by the slit can be pushed apart by a user with fingers of one hand for convenient one-handed access to the wipes, and the positioning of the slit to one side of the stack ensures that the remainder of the package contains evaporation of solvent from the wet wipes from escaping the package.

14. A method of using wet wipes according to claim 13, wherein the wet wipes are saturated with a solution of isopropyl alcohol solvent and water and used to clean car surfaces prior to painting.

* * * * *